US006408822B1

(12) United States Patent
Rembold et al.

(10) Patent No.: US 6,408,822 B1
(45) Date of Patent: Jun. 25, 2002

(54) FUEL SUPPLY SYSTEM FOR AN INTERNAL COMBUSTION ENGINE ESPECIALLY OF A MOTOR VEHICLE

(75) Inventors: Helmut Rembold, Stuttgart; Ferdinand Grob, Besigheim; Hartmut Bauer, Gerlingen; Uwe Maienberg, Leonberg; Klaus Scherrbacher, Schwieberdingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/647,243

(22) PCT Filed: Jan. 27, 2000

(86) PCT No.: PCT/DE00/00230

§ 371 (c)(1),
(2), (4) Date: Oct. 10, 2000

(87) PCT Pub. No.: WO00/45037

PCT Pub. Date: Aug. 3, 2000

(30) Foreign Application Priority Data

Jan. 28, 1999 (DE) ..... 199 03 273

(51) Int. Cl.[7] ..... F02M 37/04

(52) U.S. Cl. ..... 123/447; 123/456; 123/511; 123/179.16; 123/458

(58) Field of Search ..... 123/510, 511, 123/514, 457, 458, 497, 447, 179.16, 179.17, 516

(56) References Cited

U.S. PATENT DOCUMENTS

| | | | | | |
|---|---|---|---|---|---|
| 4,807,583 | A | * | 2/1989 | Thornthwaite et al. | 123/516 |
| 5,207,203 | A | * | 5/1993 | Wagner et al. | 123/514 |
| 5,327,872 | A | * | 7/1994 | Morikawa | 123/516 |
| 5,373,829 | A | * | 12/1994 | Schuers et al. | 123/514 |
| 5,558,068 | A | * | 9/1996 | Kunishima et al. | 123/516 |
| 5,605,133 | A | * | 2/1997 | Tuckey | 123/458 |
| 5,718,207 | A | * | 2/1998 | Ito | 123/497 |
| 5,878,718 | A | * | 3/1999 | Rembold et al. | 123/456 |
| 6,257,204 | B1 | * | 7/2001 | Kamijo et al. | 123/456 |

FOREIGN PATENT DOCUMENTS

| | | |
|---|---|---|
| DE | 43 21 718 | 1/1995 |
| DE | 195 39 885 | 11/1996 |
| DE | 197 12 143 | 9/1998 |
| EP | 0 643 219 | 3/1995 |
| FR | 2763100 | 11/1998 |

* cited by examiner

*Primary Examiner*—Thomas N. Moulis
(74) *Attorney, Agent, or Firm*—Walter Ottesen

(57) ABSTRACT

A fuel supply system (1) for an internal combustion engine, especially of a motor vehicle, is described which is provided with an accumulator (2) and a pump (6, 10). Fuel can be supplied to the accumulator (2) with the pump (6, 10). A control apparatus (16) is provided for controlling (open loop and/or closed loop) the pressure in the accumulator (2) by a pressure control valve (4). With the control apparatus (16), the pressure control valve (4) can be closed when the engine is intended to be started but no rotational movement is yet present.

6 Claims, 3 Drawing Sheets

FUEL SUPPLY SYSTEM FOR AN INTERNAL COMBUSTION ENGINE ESPECIALLY OF A MOTOR VEHICLE

FIELD OF THE INVENTION

The invention relates to a method for operating a fuel supply system for an internal combustion engine, especially of motor vehicle, wherein fuel is pumped by a pump into an accumulator and wherein the pressure in the accumulator can be controlled (open loop and/or closed loop) by means of a pressure control valve. Furthermore, the invention relates to a fuel supply system for an internal combustion engine, especially of a motor vehicle, having an accumulator and a pump with which fuel can be supplied to the accumulator; and with a control apparatus for controlling (open loop and/or closed loop) the pressure in the accumulator by means of a pressure control valve.

BACKGROUND OF THE INVENTION

Ever higher requirements are imposed on internal combustion engines, for example, of a motor vehicle, with respect to a reduction of the fuel consumption and the generated exhaust gases while, at the same time, wanting an increased power. For this purpose, modern internal combustion engines are provided with a fuel supply system wherein the supply of fuel into the combustion chamber of the engine is electronically controlled (open loop and/or closed loop) with a computer-supported control apparatus. Here, it is possible to inject the fuel into an air-intake manifold of the engine or directly into the combustion chamber thereof.

It is necessary that the fuel be injected into the combustion chamber under pressure especially in the last-mentioned type, the so-called direct injection. For this purpose, an accumulator is provided into which the fuel is pumped by a pump and is subjected to high pressure. From there, the fuel is injected into the combustion chambers of the engine via injection valves.

When starting the engine, the above-mentioned high pressure is mostly not present or is at least not immediately present. The starting of the engine must therefore be separately controlled (open loop and/or closed loop). Here, the peripheral conditions, which were already mentioned, such as reduced toxic substance discharge, are to be satisfied.

SUMMARY OF THE INVENTION

It is an object of the invention to provide a method for operating a fuel supply system for an internal combustion engine with which a starting of the engine as optimal as possible can be carried out.

This object is achieved in a method or a fuel supply system of the above-mentioned type in accordance with the invention in that the pressure control valve is closed when the engine is intended to be started but no rotational movement is yet present.

By closing the pressure control valve, a defined state of the engine is provided for the start operation, which is about to begin. Likewise, with this, it is achieved that the pressure in the accumulator no longer diminishes.

When the pressure control valve is closed by switching on the ignition and when, because of this switch-on of the ignition, the pump is also switched on for pumping the fuel into the accumulator, then this has the consequence that the pressure in the accumulator is dependent upon the pumping capacity of the pump and, if necessary, increases correspondingly. This especially advantageous for the intended starting of the engine.

The pressure control valve is at least partially opened in an advantageous embodiment of the invention when the engine is started and the first rotational movements are present. In this way, it is possible to control (open loop and/or closed loop) the pressure in the accumulator with the aid of the pressure control valve.

The pressure control valve is opened in dependence upon the temperature of the engine in an advantageous further embodiment of the invention. In this way, the pressure in the accumulator can be adapted to the temperature of the engine.

In another advantageous embodiment of the invention, the pressure control valve is opened in dependence upon the number of injections into the engine already carried out. In this way, the engine can be adapted in a simple manner to the course of the start operation.

In one embodiment of the invention, the pressure control valve is controlled (open loop and/or closed loop) in correspondence to a normal operation when a pregiven rpm limit is exceeded. In a simple manner, the transition of the control (open loop and/or closed loop) of the engine from the start operation into the normal operation is achieved.

The realization of the method of the invention in the form of a control element is of special significance with the control element being provided for a control apparatus of an engine, especially of a motor vehicle. Here, a program is stored on the control element which can be run on a computing apparatus and especially on a microprocessor and is suitable for carrying out the method of the invention. In this case, the invention is realized by a program stored on the control element so that this control element, which is provided with the program, defines the invention in the same manner as the method which the program is suitable to carry out. As a control element, especially an electrical storage medium can be used, for example, a read-only-memory.

Further features, applications and advantages of the invention become evident from the subsequent description of the embodiments of the invention which are shown in the figures of the drawing. All of the described or illustrated features define the invention with respect to themselves or in any desired combination independently of their relationship in the patent claims or their antecedent reference as well as independently of their formulation or presentation in the description or in the drawing.

DESCRIPTION OF THE PREFERRED EMBODIMENTS OF THE INVENTION

Figure 1:
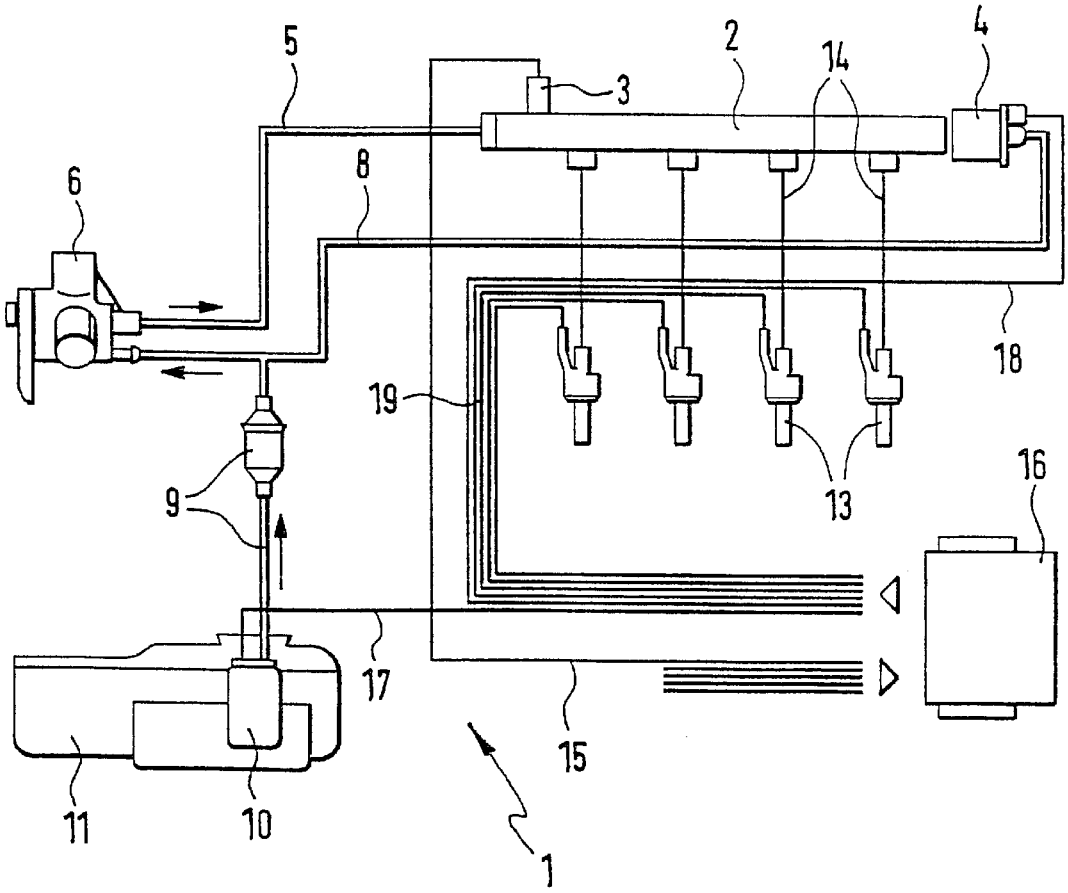
FIG. 1 is a schematic representation of an embodiment of a fuel supply system of the invention.

In FIG. 1, a fuel supply system 1 is shown which is provided for application in an internal combustion engine of a motor vehicle. The fuel supply system 1 is a so-called common rail system which is used especially for an internal combustion engine having gasoline direct injection.

The fuel supply system 1 includes an accumulator 2 which is provided with a pressure sensor 3 and a pressure control valve (DSV) 4. The accumulator 2 is connected via a pressure line 5 to a high pressure pump 6. The high pressure pump 6 is coupled to the engine and generates a high pressure when the engine rotates. The high pressure pump 6 is connected via pressure line 8 to the pressure control valve 4. The pressure control valve 4, and therefore also the high pressure pump 6, is connected to an electric fuel pump 10 via a pressure line 9 and a filter. The fuel pump 10 is suitable for inducting fuel from a fuel tank 11. The electrical fuel pump 10 generates a pressure as soon as a voltage is applied thereto. This is at least the case for a short time when the ignition of the vehicle is switched on.

The fuel supply system 1 includes four injection valves 13 which are connected via pressure lines 14 to the accumulator 2. The injection valves 13 are suitable for injecting fuel into corresponding combustion chambers of the engine.

The pressure sensor 3 is connected to a control apparatus 16 by a signal line 15. A plurality of other signal lines are connected to the control apparatus 16 as input lines. The fuel pump 10 is connected via a signal line 17 to the control apparatus 16 and the pressure control valve 4 is connected via a signal line 18 to the control apparatus. Furthermore, the injection valves 13 are connected by signal lines 19 to the control apparatus 16.

In normal operation of the engine, the fuel is pumped by the fuel pump 10 from the fuel tank 11 to the high pressure pump 6. A pressure is generated in the accumulator 2 with the aid of the high pressure pump 6 and this pressure is measured by the pressure sensor 3 and can be controlled (open loop and/or closed loop) by a corresponding actuation of the pressure control valve 4 and/or control of the fuel pump 10 to a desired value. The fuel is then injected into the combustion chambers of the engine via the injection valves 13.

Inter alia, the pressure in the accumulator 2 is essential for determining the fuel quantity to be injected into the particular combustion chamber. The greater the pressure in the accumulator 2, the more fuel is injected into the combustion chamber during the same injection time. This pressure in the accumulator 2 can be controlled (open loop and/or closed loop) by the control apparatus 16.

For this purpose, the control apparatus 16 controls, for example, the pressure control valve 4 into its closed state so that the high pressure pump 6 and the fuel pump 10 generate an ever increasing pressure in the accumulator 2. This increasing pressure can be measured by the pressure sensor 3.

Likewise, it is possible that the control apparatus 16 increases the rpm of the fuel pump 10 which leads to an increased pumping capacity of the fuel pump 10 and, as a consequence, to an increased pressure in the accumulator 2. The increase of this pressure, and therefore the increase of the rpm or the capacity of the fuel pump 10, can likewise be determined via the pressure sensor 3.

For starting the engine, a plurality of special peripheral conditions must be considered. This is carried out by the control apparatus 16 with the method shown with respect to FIGS. 2 and 3. Here, the individual blocks of the method can be realized in the control apparatus 16, for example, as modules of a program or the like.

Figure 3:
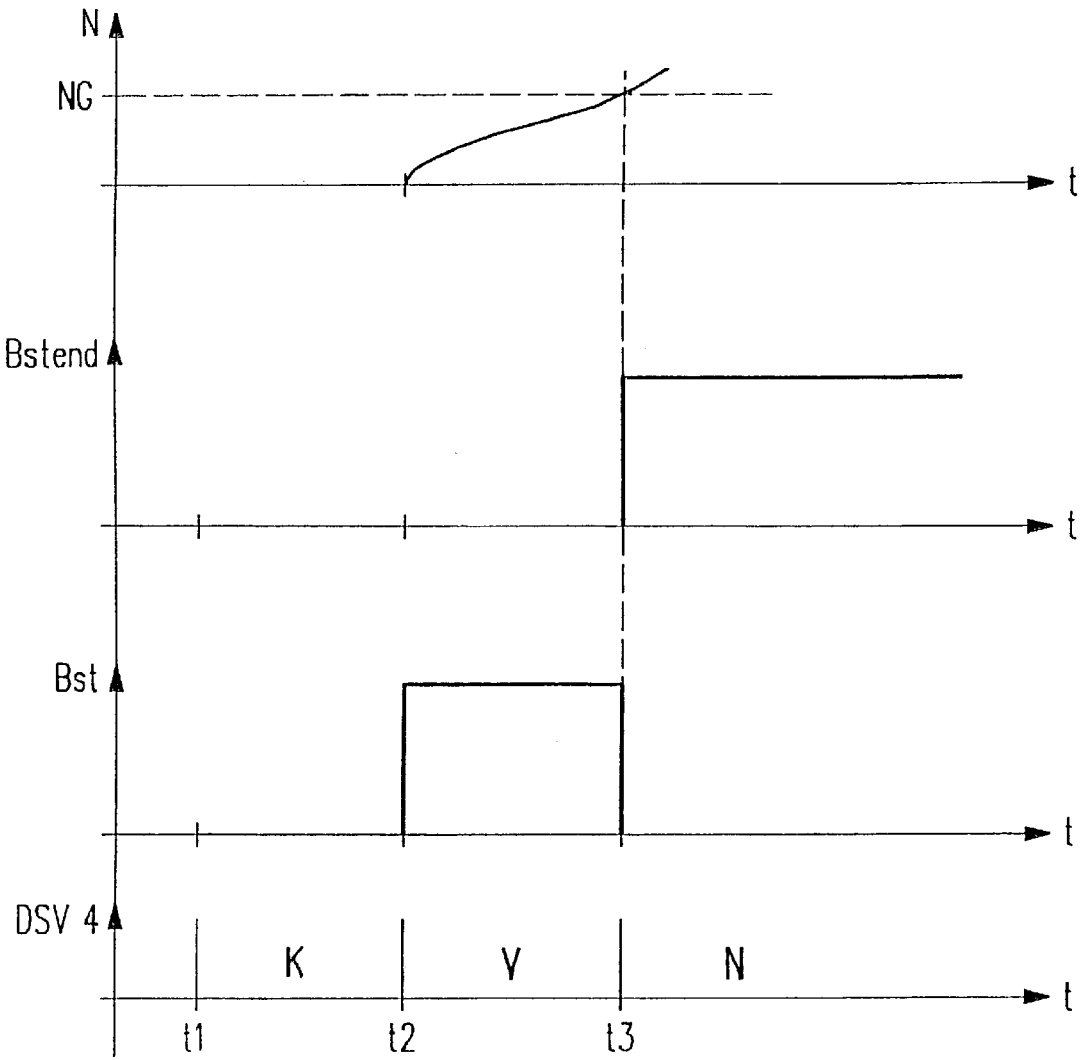

In advance of time point t1 shown in FIG. 3, the ignition of the engine is not yet switched on and the starter of the engine is not yet actuated. The two binary signals Bst and Bstend shown in FIG. 3 have a state which is not relevant at least for the present description.

After time point t1, the binary signals Bst and Bstend have the following characteristics: the binary signal Bst is only "1" when the ignition is switched on and the starter imparts a rotational movement to the engine, however, the engine has not yet exceeded a pregiven rpm limit NG. The binary signal Bstend is "1" when the starting of the engine has ended, that is, the engine has exceeded the pregiven rpm limit NG.

At time point t1, the ignition of the engine is switched on, the starter, however, does not execute a rotational movement. This means that a user of the vehicle wants to start the engine but the engine does not yet execute a rotational movement. The binary signals Bst and Bstend are "0" at time point t1. Starting at time point t1 up to time point t2, the ignition remains switched on and the starter is not yet actuated. The binary signals Bst and Bstend remain at "0".

The pressure control valve 4 is closed in the time span between the time points t1 and t2. For this purpose, and according to FIG. 2, a pregiven, preferably constant clock pulse duty factor K is transmitted via two switches (20, 21) to the pressure control valve 4. The pressure control valve 4 is transferred into its closed state at the clock pulse duty factor K if the pressure control valve is not closed or the closed condition of the pressure control valve 4 is maintained.

For this purpose, the two binary signals Bst and Bstend are inverted by two inverters (22, 23) and supplied to an AND element 24. A binary "1" is generated by the AND element 24 which transfers the switch 20 into that state which is not shown in FIG. 2.

Figure 2:
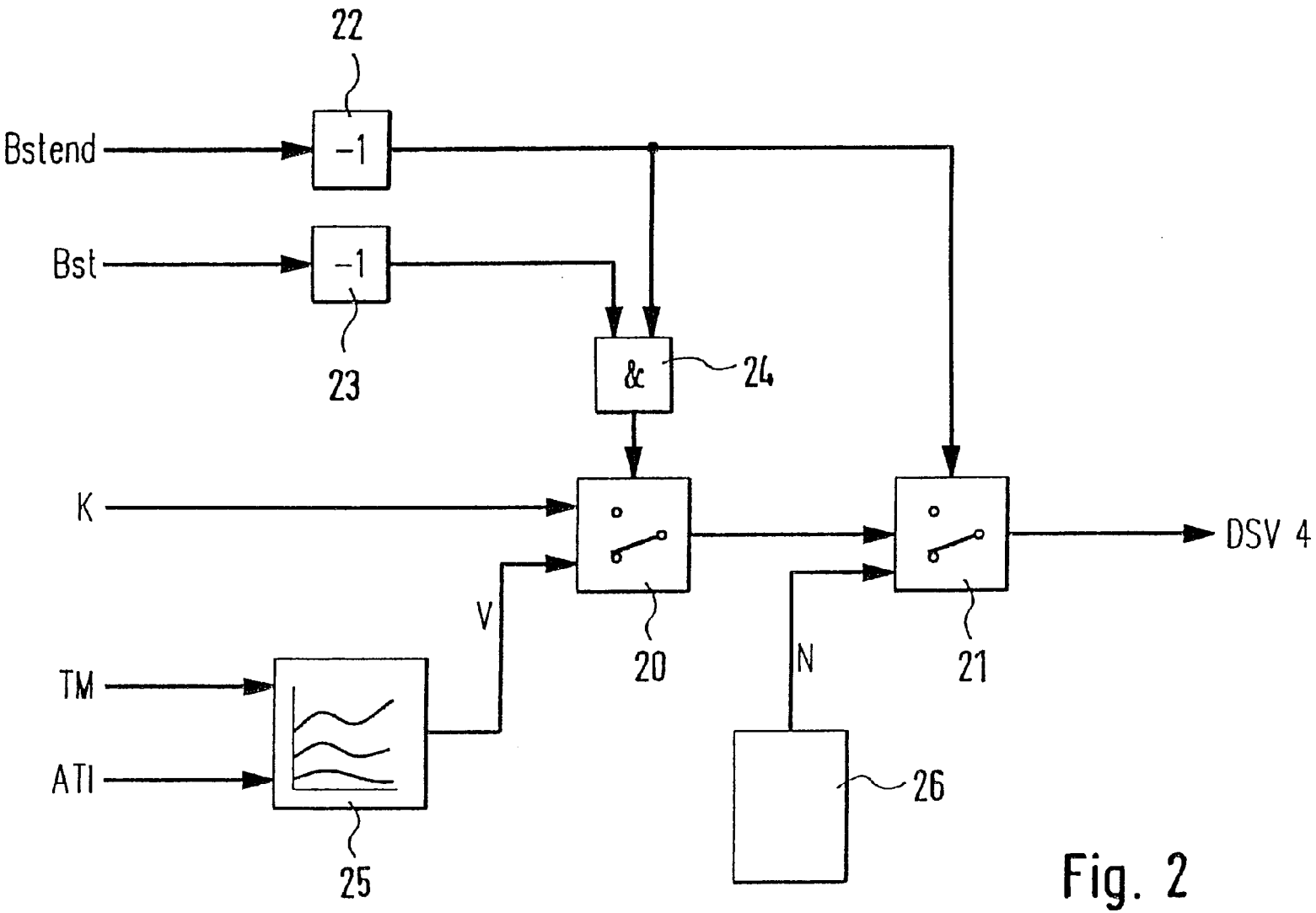
FIG. 2 shows a schematic block diagram of an embodiment of the method of the invention for operating the fuel supply system of FIG. 1; and, FIG. 3 shows a schematic time diagram for the method of FIG. 2.

Furthermore, the inverted binary signal Bstend, that is, a binary "1" is supplied to the switch 21 which transfers this switch into that state which is not shown in FIG. 2.

This effects, overall, that, as already mentioned, the clock pulse duty factor K is transmitted via the switches (20, 21) to the pressure control valve 4.

The starter imparts a rotational movement to the engine at time point t2 of FIG. 3. In this way, the binary signal Bst becomes "1". Likewise, the rpm N of the engine becomes unequal to zero and increases. As soon as the engine executes a rotational movement under its own power because of the executed injections of fuel into the combustion chambers thereof, the rpm N of the engine increases further. The engine is started.

As soon as the rpm N of the engine exceeds the rpm limit NG, for example, 800 rpm, the binary signal Bst again becomes "1" and the binary signal Bstend becomes "1". This takes place in FIG. 3 at time point t3.

The pressure control valve 4 is at least partially opened in the time span between time points t2 and t3. This is achieved in that a changing clock pulse duty factor V is read out from a characteristic field 25 and is transmitted via switches (20, 21) to the pressure control valve 4. Because of the changed binary signal Bst, the switch 20 drops into that state which is shown in FIG. 3. Because the binary signal Bstend is still "0" in the time span between the time points t2 and t3, the switch 21 remains in the state not shown in FIG. 3. In this way, the clock pulse duty factor V from the characteristic field 25 reaches the pressure control valve 4 via the switches (20, 21).

The characteristic field 25 is dependent upon the temperature TM of the engine and the number ATI of injections which have already been carried out with the then present start of the engine. It is possible that the characteristic field 25 alternatively and/or additionally is also dependent upon other operating variables of the engine. The clock pulse duty factor V, which is generated by the characteristic field, controls the pressure control valve 4 into a mostly open state and at least not into a closed state. Intermediate states are likewise possible.

At time point t3, the engine reaches the already-mentioned rpm limit NG. This has the consequence that the start of the engine is completed and the binary signal Bstend becomes "1". The inverted binary signal Bstend, that is, a binary "0", effects that the switch 21 remains in the state shown in FIG. 3. In this way, neither the clock pulse duty factor K nor the clock pulse duty factor V is transmitted to the pressure control valve 4.

In lieu of the above, a clock pulse duty factor N is transmitted to the pressure control valve 4 which is generated in a normal operation of the engine. This normal operation was already explained and is shown in FIG. 2 by block 26.

Overall, the following start operation of the engine results.

The pressure control valve 4 can have any state opened or closed before time point t1, that is, before the switch-on of the ignition and before the start of the starter.

The pressure control valve 4 is closed at time t1, that is, as soon as the ignition of the motor vehicle is switched on. This state is maintained until time point t2, that is, until the starter is actuated. In this way, the pressure in the accumulator 2 in this time span is dependent upon the pressure present before the time point t1 as well as upon the pressure generated by the electrical fuel pump 10.

The pressure control valve 4 is at least partially opened at time point t2, that is, when the ignition is switched on and the starter is rotating. This state is maintained until time point t3, that is, until the start operation of the engine is ended and the rpm limit NG is reached. The high pressure pump, which is coupled to the engine, does not yet become effective because of the low rpm generated by the starter. The pressure in the accumulator 2 is therefore substantially dependent upon the electrical fuel pump 10 in this time span.

Starting at time point t3, the high pressure pump 6 becomes essentially fully active. In this way, the pressure in the accumulator starting at time point t3 is substantially dependent upon the high pressure pump 6.

What is claimed is:

1. A method for operating a fuel supply system for an internal combustion engine when starting the engine, the engine including an engine of a motor vehicle, the fuel system including an accumulator, a pump and a pressure control valve, and the method comprising the steps of:

pumping fuel into said accumulator with said pump;

controlling the pressure in said accumulator with said pressure control valve;

closing said pressure control valve when said engine is to be started but no rotational movement is yet present; and, controlling said pressure control valve in correspondence to a normal operation when a pregiven rpm limit (NG) is exceeded.

2. The method of claim 1, comprising the further step of at least partially opening said pressure control valve when the engine is started and the first rotational movements are carried out.

3. The method of claim 2, comprising the further step of opening said pressure control valve in dependence upon the temperature (TM) of said engine.

4. A method for operating a fuel supply system for an internal combustion engine including an engine of a motor vehicle, the fuel system including an accumulator, a pump and a pressure control valve, and the method comprising the steps of:

pumping fuel into said accumulator with said pump;

controlling the pressure in said accumulator with said pressure control valve;

closing said pressure control valve when said engine is to be started but no rotational movement is yet present;

at least partially opening said pressure control valve when the engine is started and the first rotational movements are carried out; and, opening said pressure control valve in dependence upon the number (ATI) of already executed injections into the engine.

5. An electrical control element, including a read-only-memory, the electrical control element being for a control apparatus of an internal combustion engine including an engine of a motor vehicle, a program being stored on said element which program can be run on a computing apparatus including a microprocessor, and which program is suitable for carrying out a method comprising the steps of:

pumping fuel into an accumulator with a pump;

controlling the pressure in said accumulator with a pressure control valve;

closing said pressure control valve when said engine is to be started but no rotational movement is yet present; and, controlling said pressure control valve in correspondence to a normal operation when a pregiven rpm limit (NG) is exceeded.

6. A fuel supply system for an internal combustion engine including an engine of a motor vehicle, the fuel supply system comprising:

an accumulator for holding the fuel under pressure;

a fuel pump for pumping the fuel into said accumulator;

a pressure control valve connected to said accumulator for controlling the pressure of said fuel therein;

means for closing said pressure control valve when said engine is intended to be started but no rotational movement is yet present; and, means for controlling said pressure control valve in correspondence to a normal operation when a pregiven rpm limit (NG) is exceeded.

* * * * *